United States Patent [19]

Engman

[11] Patent Number: 5,060,808

[45] Date of Patent: Oct. 29, 1991

[54] HANGING FILE SUPPORT FRAME

[75] Inventor: Arnold B. Engman, Des Moines, Iowa

[73] Assignee: EMCO Industries, Inc., Des Moines, Iowa

[21] Appl. No.: 399,762

[22] Filed: Aug. 28, 1989

[51] Int. Cl.[5] ..... A47F 5/00

[52] U.S. Cl. ..... 211/46; 211/189; 312/184

[58] Field of Search ..... 211/46, 162, 189; 312/184, 183

[56] References Cited

U.S. PATENT DOCUMENTS

| | | | |
|---|---|---|---|
| 3,295,697 | 1/1967 | Patterson | 312/184 X |
| 3,999,663 | 12/1976 | Walter et al. | 312/184 X |
| 4,526,277 | 7/1985 | Snowden et al. | 312/184 X |

*Primary Examiner*—Robert W. Gibson, Jr.

*Attorney, Agent, or Firm*—Zarley, McKee, Thomte, Voorhees & Sease

[57] ABSTRACT

The hanging file support frame of this invention includes two spaced apart end members of integral construction dwelling in substantially vertical planes, and having upper and lower portions. The end members include an upper horizontal strut extending across the lateral width of the end members, with the ends thereof terminating into C-shaped members. Two elongated parallel hanging bars have their opposite ends supported within the C-shaped members. Clip elements engage the ends of the hanging bars and the C-shaped members to maintain the connection therebetween. Leg portions extend downwardly and outwardly from the C-shaped members, and the lower end of each leg portion terminates in an inwardly extending horizontal foot.

6 Claims, 2 Drawing Sheets

HANGING FILE SUPPORT FRAME

BACKGROUND OF THE INVENTION

It is common for desk drawers and the like to have frames therein which support hanging files. The frames of the prior art are normally comprised of a plurality of pieces which require substantial fabrication operations, and are relatively difficult to assemble.

It is therefore a principal object of this invention to provide a hanging file support frame which is comprised of a minimum number of components, and which can be easily and quickly fabricated and assembled.

A further object of this invention is to provide a hanging file support frame which is both stable and sturdy.

A still further object of this invention is to provide a hanging file support frame which is economical of manufacture, and durable in use.

These and other objects will be apparent to those skilled in the art.

SUMMARY OF THE INVENTION

The hanging file support frame of this invention includes two spaced apart end members of integral construction dwelling in substantially vertical planes, and having upper and lower portions. The end members include an upper horizontal strut extending across the lateral width of the end members, with the ends thereof terminating into C-shaped members.

Two elongated parallel hanging bars have their opposite ends supported within the C-shaped members. Clip elements engage the ends of the hanging bars and the C-shaped members to maintain the connection therebetween.

Leg portions extend downwardly and outwardly from the c-shaped members, and the lower end of each leg portion terminates in an inwardly extending horizontal foot.

DESCRIPTION OF THE PREFERRED EMBODIMENT

Figure 1:
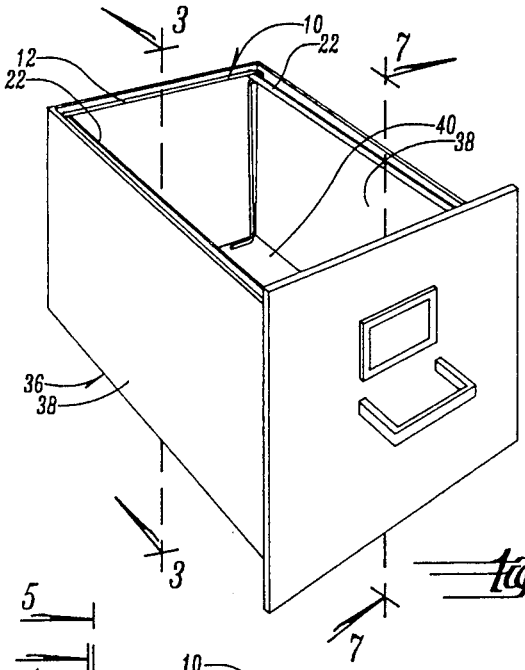
FIG. 1 is a perspective view of a file drawer with the hanging file support frame of this invention mounted therein.
Figure 2:
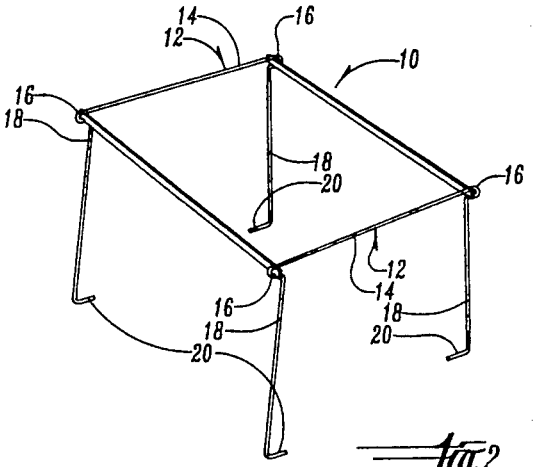
FIG. 2 is a perspective view of the assembled hanging file support frames.

Numeral 10 designates the hanging file support frame comprised of end members 12. The end members have a horizontal upper strut 14 whose opposite ends terminate in C-shaped members 16. Legs 18 extend downwardly and outwardly from the C-shaped members 16. The lower ends of the legs 18 terminate in horizontally and inwardly extending feet 20.

The end members are of integral construction and are preferably fabricated from a length of rod material being circular in cross section.

Figure 4:
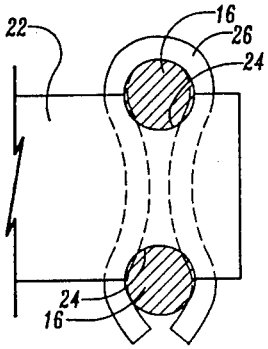
FIG. 4 is a partial sectional view taken on line 4—4 of FIG. 3.
Figure 6:
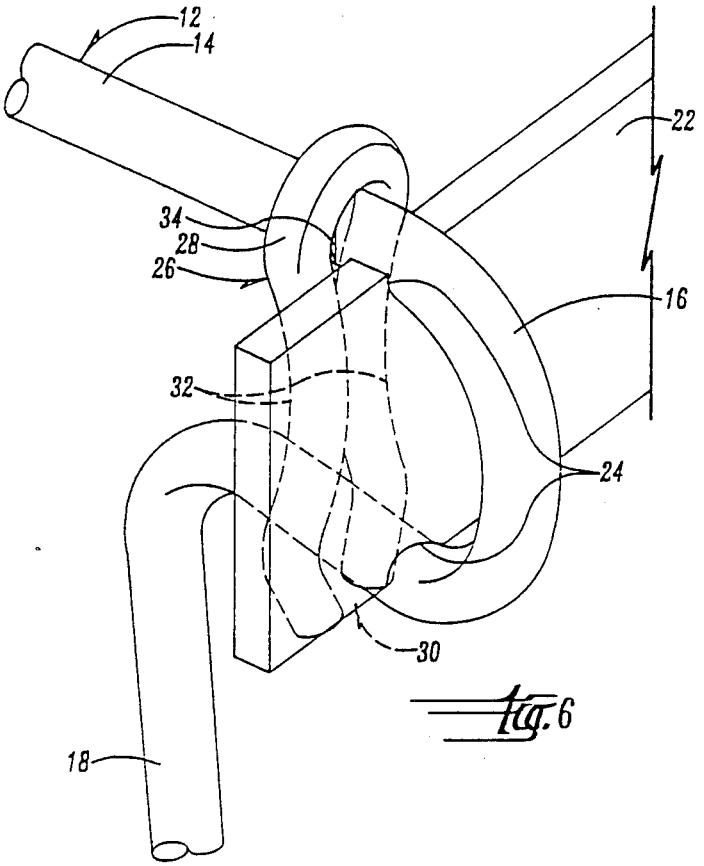
FIG. 6 is an enlarged scale partial perspective view of a connection between an end member and one of the hanging bars.
Figure 7:
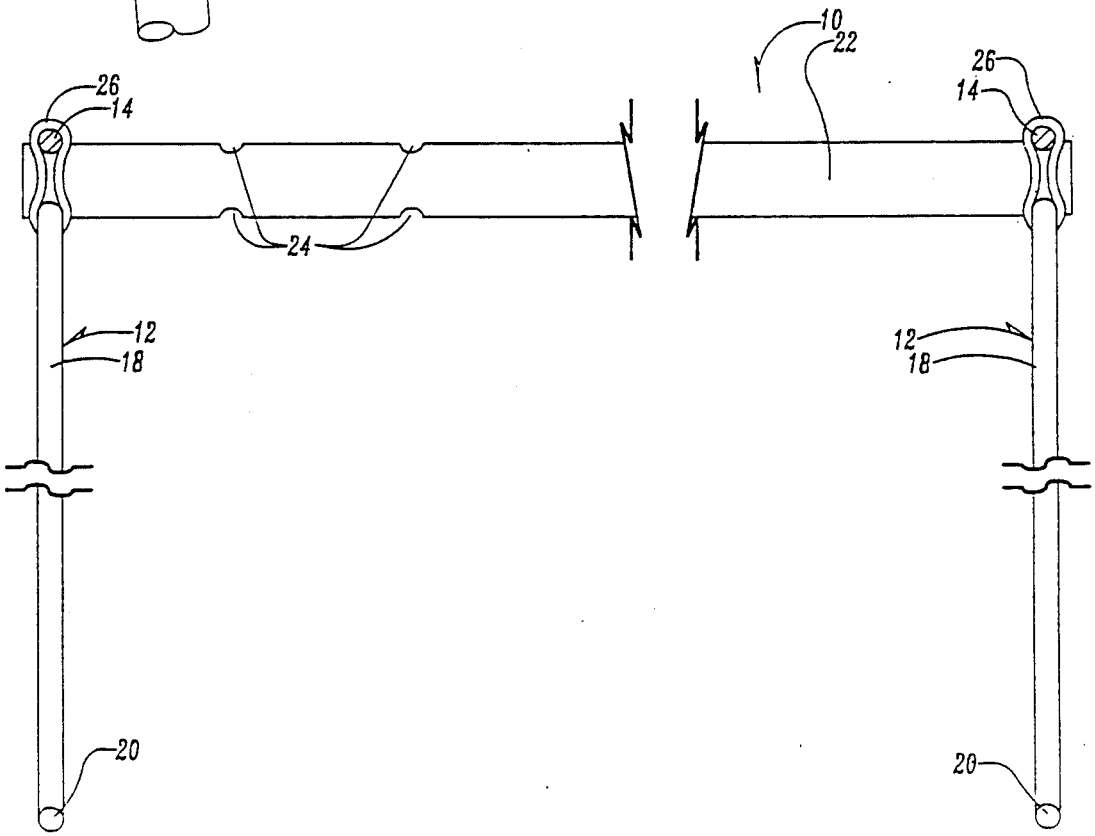
FIG. 7 is a partial sectional view taken on line 7—7 of FIG. 1.

Elongated hanging bars 22 have circular notches 24 at the ends thereof in both the upper and lower edges. As seen in FIGS. 4 and 6, the notches 24 receive the upper and lower portions of the C-shaped member 16.

Clip elements 26 are comprised of wire or the like and are U-shaped. The clip elements have a closed top 28, an open bottom 30, and inwardly bent midsection 32.

Figure 5:
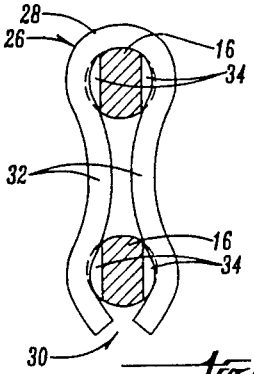
FIG. 5 is an enlarged scale sectional view taken on line 5—5 of FIG. 3.

Notches 34 are present in the lateral sides of the C-shaped member 16. As best shown in FIG. 5, these notches 24 receive the inward portions of the clip elements 26.

Figure 3:
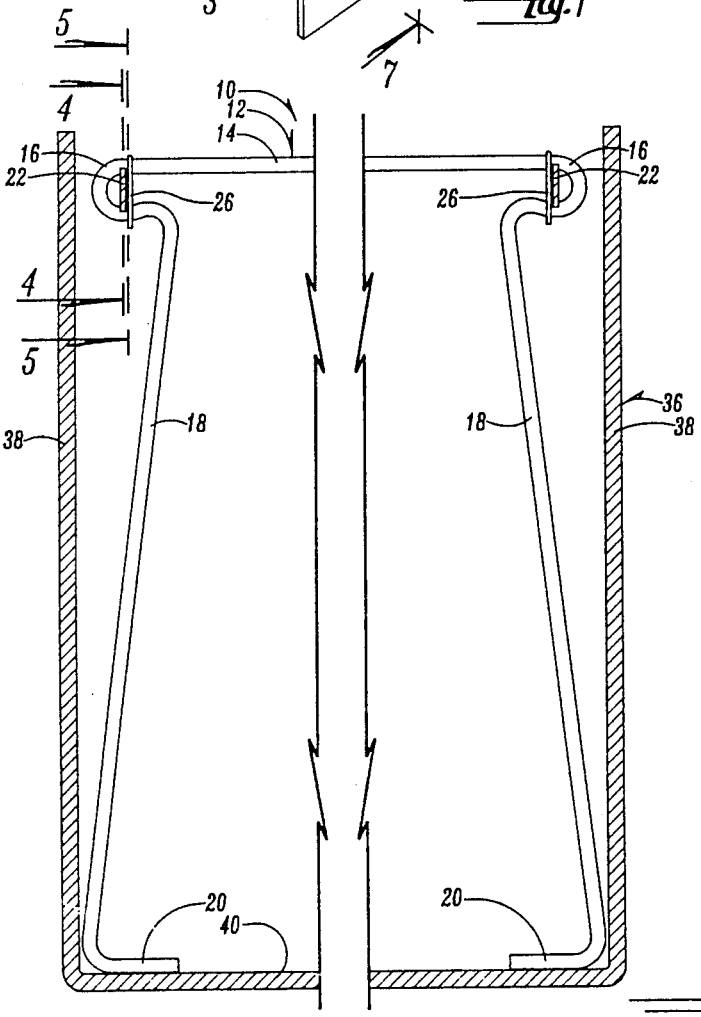
FIG. 3 is an enlarged scale sectional view taken on line 3—3 of FIG. 1.

Again, with reference to FIGS. 3 and 6, the end of hanging bars 22 cannot move laterally outwardly because of the curved portion of the C-shaped member 16. Further, they are also prevented from moving laterally inwardly because of the presence of the clip elements 26 on the inward sides thereof.

The file drawer 36 is of conventional construction and includes sides 38 and bottom 40. The lateral width of the end members at the bottom portion thereof can be slightly greater than the interior width of the drawer so that the legs 18 are slightly compressed inwardly when the support frame 10 is mounted within the drawer. This facilitates the stabilization of the frame within the drawer.

From the foregoing, it is seen that the hanging file support frame of this invention is comprised of only three separately fabricated parts. Its assembly is accomplished quickly and easily, and a very strong and sturdy frame results.

It is, therefore, seen that this invention accomplishes at least all of its stated objectives.

I claim:

1. A hanging file support frame, comprising, two spaced apart end members of integral one piece construction dwelling in substantially vertical planes, and having upper and lower portions, said end members comprising a horizontal strut with opposite ends terminating in C-shaped members, with said C-shaped members terminating in downwardly and outwardly extending leg portions, two parallel hanging bars each having opposite ends supported by the upper portions of said end members, with the ends of said hanging bars being supported within said C-shaped members, and clip elements detachably securing the ends of said hanging bars to said C-shaped members.

2. The device of claim 1 wherein said leg portions have lower ends that terminate in inwardly extending foot portions.

3. The device of claim 1 wherein said end members are comprised of rod material which is circular in cross section.

4. A hanging file support frame, comprising, two spaced apart end members of integral construction dwelling in substantially vertical planes, and having upper and lower portions, two parallel hanging bars each having opposite ends supported by the upper portions of said end members, and clip elements detachably securing the ends of said hanging bars to the upper portion of said end members, the upper portion of said end members including a horizontal strut extending across the lateral width of said end members, said horizontal strut having opposite ends that are formed into C-shaped members with the ends of said horizontal bars being supported within C-shaped members, said clip elements detachably securing the ends of said hanging bars to said C-shaped members, said hanging bars being notched at their ends, with said notches receiving C-shaped members.

5. The device of claim 4 wherein said clip elements are U-shaped wire members which frictionally engage said C-shaped members.

6. The device of claim 5 wherein said C-shaped members are notched adjacent the ends of said hanging bar, and said clip elements are received in said notches.

* * * * *